US005457857A

United States Patent [19]

Lam

[11] Patent Number: 5,457,857

[45] Date of Patent: Oct. 17, 1995

[54] PIVOTED CLAMP

[76] Inventor: Ching-Keung Lam, Flat B-6, 4/F, Eastern Block, Pearl Island Villas, Pearl Island, Castle Peak, NT, Hong Kong

[21] Appl. No.: 188,766

[22] Filed: Jan. 31, 1994

[51] Int. Cl.[6] ..... A44B 21/00

[52] U.S. Cl. ..... 24/503; 24/515

[58] Field of Search ..... 248/316.5; 24/502–505, 24/510, 517, 515

[56] References Cited

U.S. PATENT DOCUMENTS

| | | | |
|---|---|---|---|
| 483,963 | 10/1892 | Leger | 248/316.5 X |
| 902,795 | 11/1908 | Appleton | 24/505 X |
| 1,797,452 | 3/1931 | Teel | 24/503 |
| 3,955,249 | 5/1976 | Shiozaki | 24/505 X |
| 4,175,306 | 11/1979 | Bigelow et al. | 24/510 X |
| 4,489,466 | 12/1984 | Bakker | 24/504 X |

*Primary Examiner*—James R. Brittain

*Attorney, Agent, or Firm*—Burns, Doane, Swecker & Mathis

[57] ABSTRACT

A clamp, for example of the conventional "clothes peg" type, is provided with a wedging device 9 which may be selectively locatable between the rear ends of the two clamping members 2 so as to urge the rear ends apart, and thereby by virtue of the pivotal connection 4 between the clamping members 2 to urge the clamping jaws 3 together. In this way the wedging device 9 acts to increase the strength of the clamp in order to reduce the possibility of the items held between the jaws of the clamp from slipping out of the clamp. A locking member is also provided to prevent the wedging member from being unintentionally released.

9 Claims, 2 Drawing Sheets

PIVOTED CLAMP

FIELD OF THE INVENTION

This invention relates to a clamp, for example a clamp of the type adapted to hold together items such as a number of sheets of material, possibly sheets of paper or fabric material, and in particular the invention relates to such a clamp provided with means for increasing the clamping force so as to more securely clamp the items in place.

BACKGROUND OF THE INVENTION

There are known in the prior art a number of different existing types of clamp. One such known clamp is the traditional "clothes peg" type clamp. Such a clamp includes a pair of clamping jaw members pivotally mounted with respect to each other, and with the jaw members being spring biassed into engagement with each other. In use or such a well-known clamp, the jaw members are moved apart against the spring bias and the items to be clamped, eg sheets of paper or clothes to be clamped to a clothes line etc., are placed between the jaws. The jaws are then allowed to close and the spring bias causes the jaws to clamp the items in place.

The strength of such a conventional clamp is largely dependent on the strength of the spring bias. A strong spring bias will provide a strong clamping action, but at the same time will also make the jaws difficult to open to insert the items to be clamped, and thus make the clamp awkward to use. A weak spring bias makes it easier to open the jaws, but also of course reduces the strength of the clamping action. Even where there is a strong clamping action, if the items being clamped are heavy and the clamp is used to suspend them, there remains the possibility that the weight of the items will drag them from the jaw members of the clamp.

SUMMARY OF THE INVENTION

According to the present invention there is provided a clamp comprising;

(a) a pair of clamping members, each said clamping member including a jaw member, and said clamping members being pivotally mounted with respect to each other, (b) spring means for biassing said clamping members such that said jaw members are urged towards each other, and (c) wedging means locatable between said clamping members to urge the ends of said clamping members remote from said jaw members apart whereby said jaw members are urged together.

By means of this arrangement additional clamping pressure may be provided by selectively locating the wedging means between the clamping members so as to urge the ends of the clamping members remote from the jaw members apart. By virtue of the pivotal mounting of the two clamping members, which is preferably provided approximately halfway along the two members, urging the remote ends of the clamping members apart has the effect of urging the jaw members together. However because the wedging means is only selectively locatable between the clamping members it need not interfere with the ease with which the clamping members may be opened to insert therebetween an item or items to be clamped.

In a particularly preferred arrangement the locatable wedging means may be locked in place between the clamping members whereby the clamp itself may thus be "locked" with the items to be clamped securely held therein.

Preferably the locatable wedging means comprises a substantially conical member which is adapted to be moved between the clamping members until it contacts them and urges them apart.

The clamp may preferably include guide means, for example a rod, extending from the pivot point of the two clamping members to a point beyond the rear ends of the two clamping members, ie those ends remote from the jaw members, and said locatable wedging means may be adapted to move along said guide means.

In a particularly preferred arrangement the wedging means is adapted to slide upon the guide means until the wedging means contacts the clamping members, and wherein selectively engageable screw drive means are provided whereby subsequent engagement of the wedging means against the clamping members may be tightened. In such an arrangement the locking means comprises means to prevent contrary rotation of said screw drive means, for example a teeth and pawl arrangement. Preferably, the wedging means comprises a tubular sleeve having an end nearest the pivot point split into two parts resiliently biassed out of contact with the guide means and provided with an inner threaded surface, and the selectively engageable drive means comprises means, such as a sliding collar, for moving said threaded surfaces of said biassed apart end parts into engagement with a threaded portion of said guide means.

The inner surfaces of the ends of the clamping members that engage the wedging means may preferably be provided with a textured surface, ie a roughened or grooved surface, and the wedging means may similarly be provided with a similar surface. This increases the friction between the wedging means and the clamping members and as such acts to reduce the likelihood of the wedging means from accidentally slipping out from between the clamping members.

BRIEF DESCRIPTION OF THE DRAWINGS

An embodiment of the invention will now be described by way of example and with reference to the accompanying drawings, in which.

DETAILED DESCRIPTION OF PREFERRED EMBODIMENT

Figure 1:
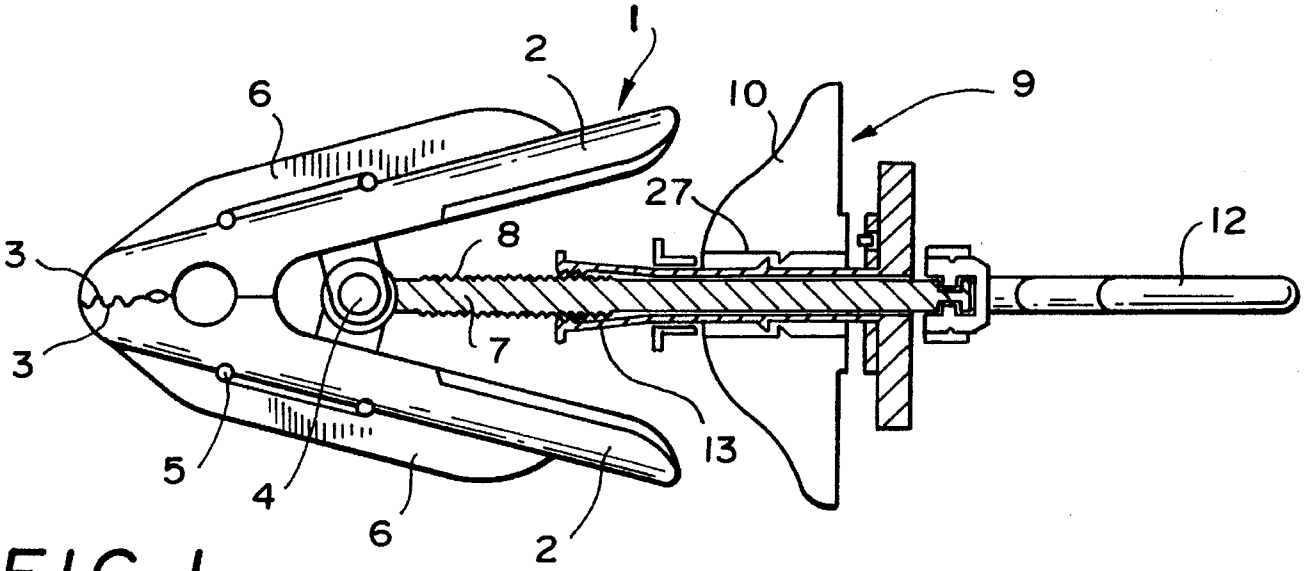
FIG. 1 is a side view partly in section of a clamp according to an embodiment of the present invention.
Figure 2:
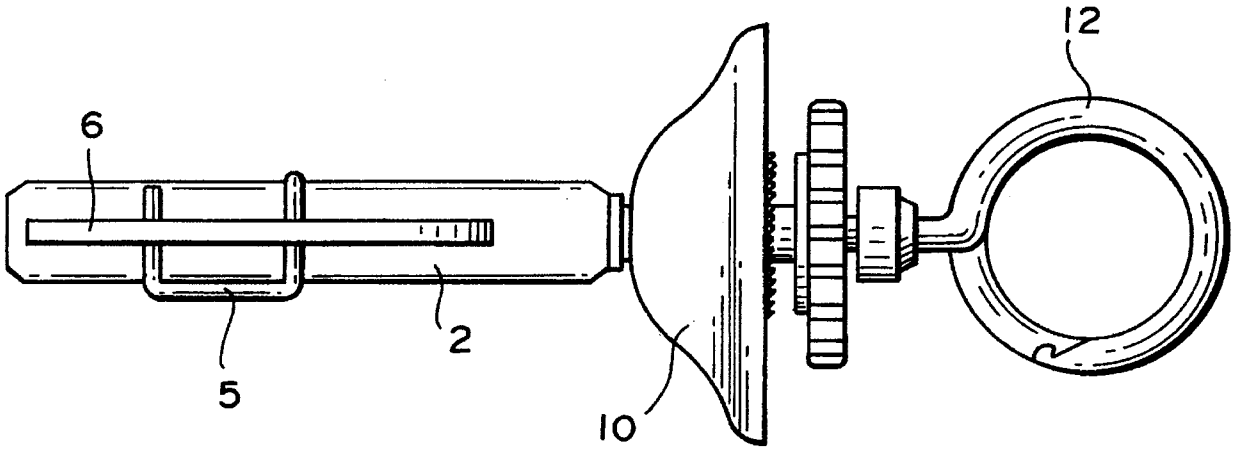
FIG. 2 is a plan view of the clamp of FIG. 1.

Referring firstly to FIG. 1 there is shown a clamp 1. The clamp 1 comprises a pair of substantially identical clamping members 2, each being provided with a clamping jaw 3 at one end. The clamping members 2 are pivotally connected to each other at pivot point 4 at a location approximately halfway along the clamping members. A spring means 5 is provided to bias the clamping members together so that the jaws 3 come together to enable them to clamp an item placed therebetween.

Each clamping member 2 is also provided with a reinforcing web 6 on its outer surface in order to strengthen the clamping members.

Extending from between the clamping members 2 to a point beyond the rear ends of the clamping members 2, ie the ends of the clamping members 2 remote from the jaws 3, is a guide means in the form of a rod 7 connected to the pivot point 4. The end of the rod 7 adjacent the pivot point 4 is provided with a threaded surface 8 for reasons that will be explained below, the remainder of the rod 7 being smooth.

Provided on the guide rod 7 is a locatable wedging means 9, the construction and use of which will be described further below with reference to FIG. 3. For the moment however it is sufficient to note that the locatable wedging means 9 comprises a generally conical wedging member 10 and a tubular sleeve 13 located within a central inner bore 27 of the wedging member 10 and surrounding the guide rod 7. It will be appreciated that if this wedging member 10 is brought into a position between the rearmost ends of the clamping members 2 it will serve to wedge those ends apart, and hence, by virtue of the pivotal connection, will urge the jaws 3 together so as to clamp tightly anything located between the jaws 3. Although generally conical in shape, the outer surface of the wedging member 10 is curved, and preferably the inner surfaces of the rear ends of the clamping members 2 are formed with a complementary curved recess 11 so as to maximise the area of contact between the surface of the wedging member 10 and the ends of the clamping members 2. The maximum diameter of the wedging member 10 is preferably greater than the maximum possible spacing between the rear ends of the clamping members 2 to prevent the wedging means 9 from moving too far between the clamping members whereby the wedging member will engage the clamping members 2 at their rear ends so as to maximise the leverage of the wedging member 10. The inner surfaces of the ends of the clamping members, and the external surface of the wedging member 10, may be provided with a roughened, grooved or otherwise textured surface to increase the friction between the clamping members 2 and the wedging member 10 so as to reduce the possibility of the wedging member from slipping from out of the ends of the clamping members 10.

The end of the guide rod 7 remote from the pivot point 4 may be formed with a loop 12 or hook by means of which the clamp 1 may be suspended in use if desired.

Figure 3:
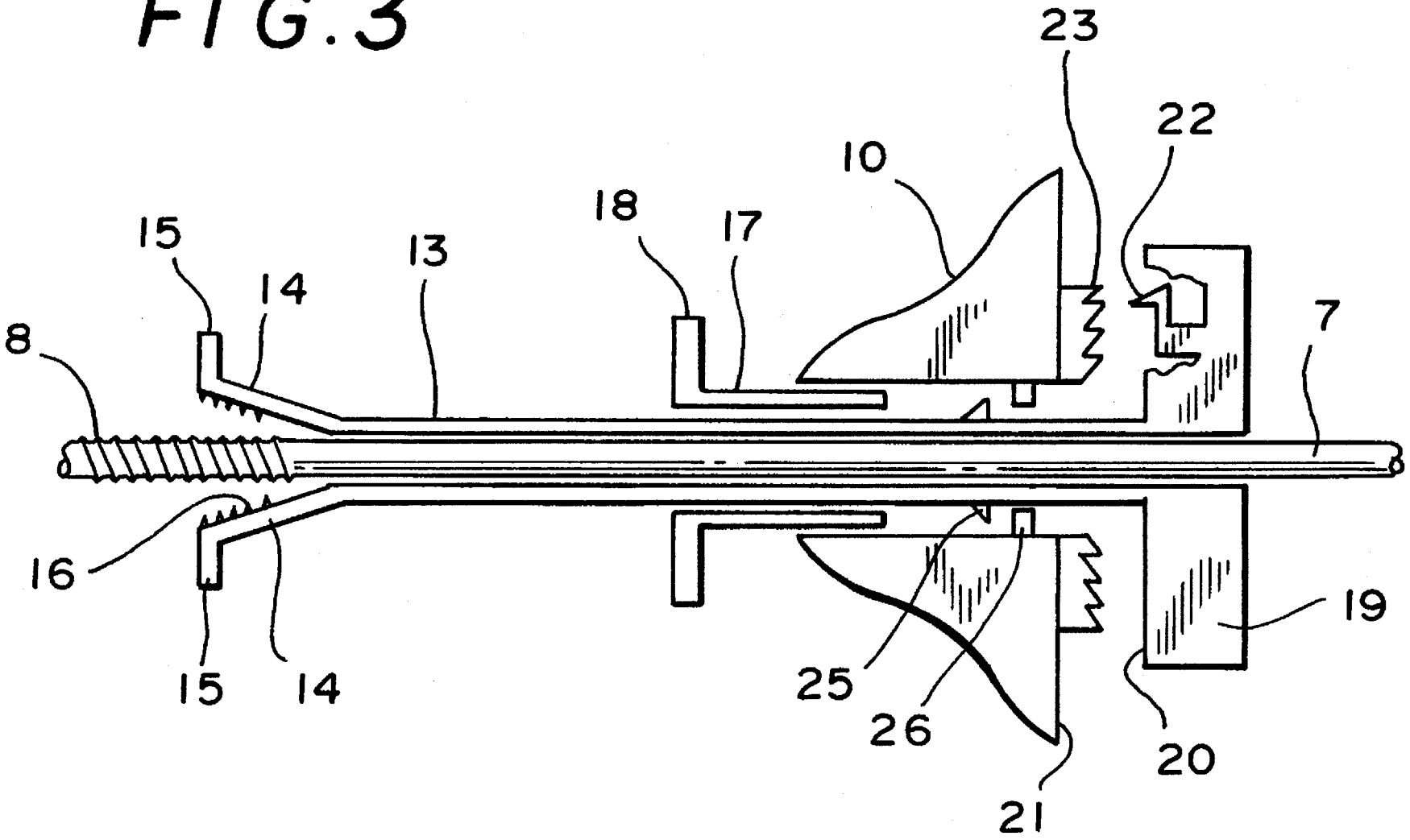
FIG. 3 is a detailed side view in section of the locatable means of the embodiment of FIG. 1.

Turning now to FIG. 3 the locatable wedging means 9 will now be described in more detail. As previously described the wedging means 9 is adapted to slide upon the guide rod 7 so as to move into and out of a position between the rear ends of the clamping members 2. The wedging means 9 includes a tubular sleeve 13 surrounding the guide rod 7. The end of the sleeve 13 closest the pivot point 4 is split to define two resilient engaging end portions 14 which are biassed slightly away from the rod 7, though this is exaggerated somewhat in FIG. 3 for the sake of clarity. The end portions 14 terminate in ribs 15, and on the inner surfaces are formed with threads 16 whose purpose will be described further below.

The other end of the tubular sleeve 13, ie the end of the sleeve remote from the pivot point, is formed with an enlarged head portion 19 which serves as a control member by means of which the sleeve 13 may be rotated. The head portion 19 has one surface 20 which faces the end surface 21 of the wedging member 10. This surface 19 is formed with a pawl member 22 adapted to engage teeth 23 formed on the rear surface 21 of the wedging member. The teeth 23 each have a vertical side and a sloping side and as such allow rotation of the head portion 19 in one direction only as will be explained below.

Surrounding the tubular sleeve 13 between the end of the sleeve 13 nearest the pivot point 4 and the wedging member 10 is a slidable collar member 17, the end of which nearest the pivot point 4 is formed with a radially extending flange 18. When the collar member is moved over the tubular sleeve 13 in the direction of the pivot point 4, the collar member 17 presses the resilient end portions 14 of the sleeve 13 inwardly so that the threaded portions 16 engage the threaded section of the guide rod 7.

Operation of the wedging means will now be described in more detail. To begin with one or more items to be clamped are placed between the jaws 3. At this stage the wedging means 9 is outside of the clamping members. However, after the items to be clamped have been located between the clamping jaws 3, the wedging means is slid along the guide rod 7 to a position between the clamping members 2 where the wedging member 10 begins to contact the inner surfaces of the clamping members. Then the collar member 17 is moved over the tubular sleeve 13 in order to move the resilient end portions 14 inwardly so that their threaded surfaces contact the threaded section of the guide rod 7.

Subsequently the head portion 19 is rotated and, by virtue of the engagement of the threaded surfaces 16 of the resilient end portions 14 with the threaded surface 8 of the guide rod 7, the tubular sleeve 13 is drawn inwardly into the space between the clamping members and moving the wedging member 10 with it until the wedging member 10 can move no further. In this position it will be seen that the clamping members 2 will be wedged apart at their rear ends so as to cause the clamping jaws 3 to very firmly engage the item(s) clamped therebetween. In this condition the item(s) clamped are very securely held and it is extremely difficult for them to become dislodged accidentally. Furthermore the pawl and teeth arrangement on the head portion 19 and the facing end surface 21 of the wedging member 10 prevents the accidental reverse rotation of the head portion 19 in a direction to loosen the wedging action.

Preferably means are also provided to prevent unwanted movement of the wedging member 10 relative to the tubular sleeve 13. This may take the form of an annular rib 25 formed on the external surface of the tubular sleeve 13 which engages a complementary projection 26 formed on the inner bore 27 of the wedging member 10.

To release the wedging means 9 when it is desired to release an item or items clamped by the jaws, all that is necessary is to slide back the collar 17 relative to the tubular sleeve 13 so as to release the resilient end pieces 14 from threaded engagement with the guide rod 7, after which the entire wedging means can simply be slid back along the guide rod 7 out of the space between the clamping members 3.

The clamp may be made out of any suitable material, such as for example a strong plastics material, metal or a combination of the two.

I claim:

1. A clamp comprising:

(a) a pair of clamping members, each said clamping member including a jaw member, and said clamping members being pivotally mounted with respect to each other, (b) spring means for biassing said clamping members such that said jaw members are urged towards each other, (c) a guide means located between said clamping members, (d) wedging means adapted to slide upon said guide means until said wedging means contacts the clamping members to thereby urge the ends of said clamping members remote from said jaw members apart, whereby said jaw members are urged together, and (e) selectively engageable screw drive means for tightening of the wedging means against the clamping members.

2. A clamp as claimed in claim 1 further comprising locking means whereby said wedging means may be locked in place between the clamping members.

3. A clamp as claimed in claim 1 wherein said guide means comprises a rod extending from the point of pivotal connection between the two clamping members to a point beyond the ends of the clamping members remote from the jaw members.

4. A clamp as claimed in claim 1 wherein locking means are provided to prevent contrary rotation of said screw drive means to loosen engagement of the wedging means with the clamping members.

5. A clamp as claimed in claim 4 wherein said locking means comprises a teeth and pawl arrangement.

6. A clamp as claimed in claim 1 wherein said wedging means comprises a tubular sleeve having an end nearest said pivot point split into two parts resiliently biassed out of contact with said guide means and provided with an inner threaded surface, and wherein said selectively engageable screw drive means comprises means for moving said threaded surfaces of said biassed apart end parts into engagement with a threaded portion of said guide means.

7. A clamp as claimed in claim 6 wherein said moving means comprises a collar adapted to slide over said resilently biassed apart end portions.

8. A clamp as claimed in claim 1 wherein each said clamping member is provided with a reinforcing web.

9. A clamp as claimed in claim 1 wherein the inner surface of the ends of the clamping members engageable by the wedging means, and the surface of the wedging means, are provided with a textured surface.

* * * * *